US005393357A

United States Patent [19]

Cho

[11] Patent Number: 5,393,357

[45] Date of Patent: Feb. 28, 1995

[54] METHOD OF MINIMIZING STRENGTH ANISOTROPY IN ALUMINUM-LITHIUM ALLOY WROUGHT PRODUCT BY COLD ROLLING, STRETCHING AND AGING

[75] Inventor: Alex Cho, Richmond, Va.

[73] Assignee: Reynolds Metals Company, Richmond, Va.

[21] Appl. No.: 957,318

[22] Filed: Oct. 6, 1992

[51] Int. Cl.[6] ..... C22F 1/00

[52] U.S. Cl. ..... 148/437; 420/528

[58] Field of Search ..... 148/437; 420/528

[56] References Cited

U.S. PATENT DOCUMENTS

| | | | |
|---|---|---|---|
| 4,648,913 | 3/1987 | Hunt, Jr. et al. | 148/416 |
| 4,797,165 | 1/1989 | Bretz et al. | 148/417 |
| 4,897,126 | 1/1990 | Bretz et al. | 148/416 |
| 4,961,792 | 10/1990 | Rioja et al. | 148/417 |
| 5,032,359 | 7/1991 | Pickens et al. | 148/417 |
| 5,066,342 | 11/1991 | Rioja et al. | 148/437 |
| 5,194,102 | 3/1993 | Wyss | 148/437 |

OTHER PUBLICATIONS

Letter dated Oct. 17, 1990 from Aluminum Association, Incorporation to Signatories of the Declaration of Accord.

*Primary Examiner*—Upendra Roy
*Attorney, Agent, or Firm*—Alan M. Biddison

[57] ABSTRACT

Strength anisotropy of aluminum-lithium alloy wrought products is reduced by subjecting these types of alloys to improved T8 temper practice. The wrought product, after solution heat treating and quenching, is subjected to a combination of cold rolling and stretching steps prior to aging. The cold rolling can range between 1 and 20% reduction with the stretching step ranging between 0.5–10%. The cold rolling step may be performed in one or a multiple of passes. When multiple passes are used, the cold rolling may be done in different directions to further enhance reductions in strength anisotropy for these types of alloys. An aluminum-lithium alloy wrought product subjected to the improved T8 temper practice has an increased minimum tensile yield stress throughout its thickness and in various directions to facilitate commercial application of the product in high strength applications.

20 Claims, 8 Drawing Sheets

METHOD OF MINIMIZING STRENGTH ANISOTROPY IN ALUMINUM-LITHIUM ALLOY WROUGHT PRODUCT BY COLD ROLLING, STRETCHING AND AGING

FIELD OF THE INVENTION

The invention is directed to minimizing strength anisotropy in aluminum-lithium alloy wrought products by subjecting a solution heated treated wrought product to a particular sequence of cold rolling followed by stretching and aging.

BACKGROUND ART

In many industries, such as the aerospace industry, one of the effective ways to reduce weight of an aircraft is to reduce the density of aluminum alloys used in the aircraft's construction. It is known in the art that aluminum alloy densities may be reduced by the addition of lithium. However, lithium in aluminum-based alloys also raises other problems. For example, the addition of lithium to aluminum alloys may result in a decrease in ductility and fracture toughness. For use as aircraft structural parts, it is obviously imperative that any alloy have excellent fracture toughness and strength properties.

Various aluminum-lithium alloys have been registered with the Aluminum Association. For example, alloys AAX2094 and AAX2095, registered in 1990, include alloying elements of copper, magnesium, zirconium, silver, lithium and inevitable impurities. U.S. Pat. No. 5,032,359 entitled "Ultra High Strength Weldable Aluminum-Lithium Alloys", issued Jul. 16, 1991, discloses an improved aluminum-copper-lithium-magnesium-silver alloy possessing high strength, high ductility, low density, good weldability and good natural aging response. Typically, these alloys consist essentially of 2.0–9.8 wt. % of an alloying element which may be copper, magnesium, or mixtures thereof, the magnesium being at least 0.01 wt. %, with about 0.01–2.0 wt. % silver, 0.05–4.1 wt. % lithium, less than 1.0 wt. % of a grain refining additive which may be zirconium, chromium, manganese, titanium, boron, hafnium, vanadium, titanium di-boride or mixtures thereof.

Another prior art alloy for use in aircraft industry application is disclosed in U.S. Pat. No. 4,648,913 to Hunt, Jr. et al. In this patent, an aluminum-based alloy is disclosed comprising 0.5–4.0 wt. % lithium, 0–5.0 wt. % magnesium, up to 5.0 wt. % copper, 0–1.0 wt. % zirconium, 0–2.0 wt. % manganese, 0–7.0 wt. % zinc, 0.5 wt. % maximum iron, 0.5 wt. % maximum silicon, the balance aluminum and incidental impurities. This alloy is subjected to heat treating and working steps to improve strength and toughness characteristics.

Despite the years of developmental effort, these aluminumlithium alloys have been selected for relatively few commercial applications. One of the reasons for such a limited commercial success of these aluminum-lithium alloy products is severe strength anisotropy of highly wrought products in high strength T8 temper conditions.

The T8 temper designation, as is well known to those skilled in the art, includes solution heat treatment, strain hardening and then artificial aging.

Subjecting aluminum-lithium alloys to conventional T8 temper practice results in a wide variation in strengths at different thickness locations and in different directions for a given wrought product. For example, the tensile yield strength of a given product can vary up to almost 20 ksi between different thicknesses and locations in the wrought product.

In the aforementioned Hunt, Jr. et al. patent and related U.S. Pat. Nos. 4,797,165 and 4,897,126 to Bretz et al. and 4,961,792 to Rioja et al., solution heat treatment, stretching and aging steps are disclosed to improve strength and toughness in aluminum-lithium alloys. In the Rioja et al. patent, stretching or equivalent working following the solution heating step is disclosed as greater than 1% and less than 14%. However, the Rioja et al. patent and the patents related thereto fail to address the deficiency in aluminum-lithium alloys regarding strength anisotropy.

As such, a need has developed to provide improved processing techniques to achieve high strength and minimize strength anisotropy to facilitate full commercial implementation of aluminum-lithium alloy wrought products.

In response to this need, the present invention provides a method of improving strength anisotropy in aluminum-lithium alloys by imparting a sequence of cold rolling and stretching steps between the solution heat treating steps and aging steps used in T8 temper practice. None of the prior art discussed above teaches or fairly suggests minimizing strength anisotropy in aluminum-lithium alloys by modifying the T8 temper practice.

Although the aforementioned patents to Bretz et al., Rioja et al. and Hunt, Jr. et al., indicate that improvement in strengths are achieved in aluminum-lithium alloys using the disclosed solution heat treatment, stretch and aging processing, these improvements in strength do not extend to all thickness locations and all directions for a given wrought product. As will be demonstrated hereinafter, the prior art stretching techniques generally provide only improvements in strength in the T/2 location and longitudinal direction. Tensile yield stresses in other locations and directions, e.g., the T/8 location and 45 degree direction, have drastically reduced strengths. Since commercial applications are based upon design requirements which must adhere to the lowest level of strength for a given alloy, the failure to increase strengths in locations and directions other than the T/2 and longitudinal direction limits the commercial acceptance of these types of alloys.

SUMMARY OF THE INVENTION

It is a first object of the present invention to provide a method for minimizing strength anisotropy in aluminum-lithium alloy wrought products.

It is another object of the present invention to provide a method of treating aluminum-lithium alloy wrought products which increases strength values across the thickness of the wrought product and in longitudinal and non-longitudinal directions.

It is a further object of the present invention to provide an aluminum-lithium wrought product having acceptable minimal levels of strength for commercial applications.

Other objects and advantages of the present invention will become apparent as the description thereof proceeds.

In satisfaction of the foregoing objects and advantages, the present invention comprises an improvement over prior art methods of producing aluminum-lithium alloy wrought products that includes the steps of solution heat treating, strain hardening and aging. In the inventive process, the solution heat treated aluminum-lithium alloy wrought product is cold rolled in at least one pass between about 1 and 20% reduction. The cold rolled product is then stretched between about 0.5 and 10%, followed by aging the product at a predetermined temperature for a predetermined time to achieve a desired strength level. The steps of cold rolling, stretching and aging minimize strength anisotropy in the wrought product. In a further aspect of the invention, the cold rolling step is performed in a plurality of passes. The percent reduction in each pass may be distributed equally or unequally to achieve the total percent reduction.

In another mode of the inventive process, the cold rolling step is performed in a plurality of passes wherein at least two of the passes are made in different directions.

The inventive method also produces an aluminum-lithium wrought product having improved strength levels in all thickness locations and directions. Specifically, in one embodiment of the invention, an aluminum-lithium alloy wrought product is produced wherein a minimum tensile yield stress is at least about 85% of the alloy wrought product's maximum tensile yield stress.

BRIEF DESCRIPTION OF DRAWINGS

Reference is now made to the Drawings accompanying the application wherein.

DESCRIPTION OF THE PREFERRED EMBODIMENTS

Figure 1:
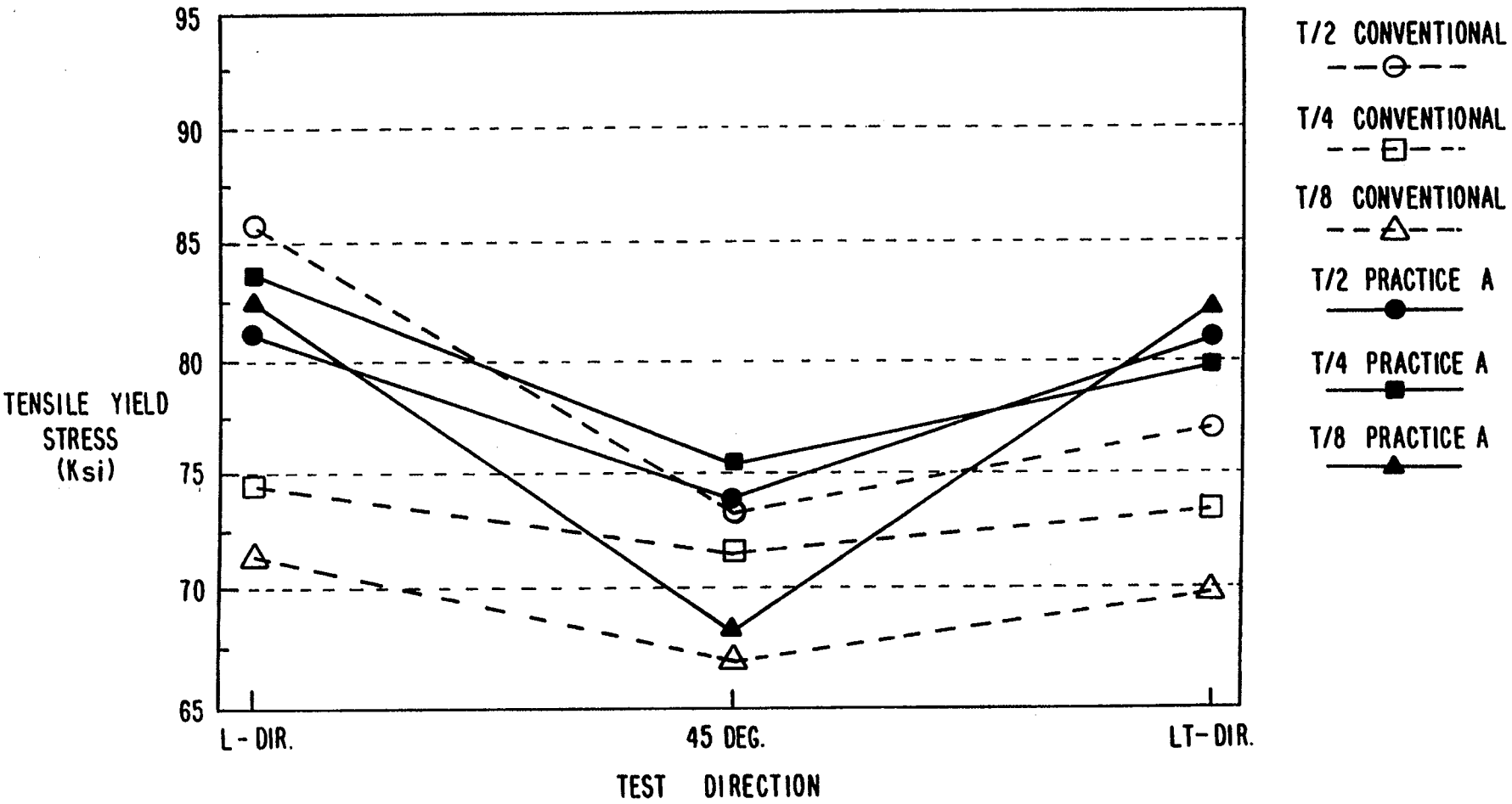
FIG. 1 is a comparison graph relating tensile yield stress and tensile test direction for different thickness locations between a conventional T8 temper and a first embodiment of the inventive process.

The present invention overcomes a serious deficiency associated with aluminum-lithium alloys regarding strength anisotropy. Aluminum-lithium alloy wrought products when subjected to conventional T8 temper practice achieve only limited benefits with respect to increased strength. The strength increases resulting from conventional T8 temper practice are not uniform with respect to the through thickness or different directions in the wrought alloy product. This severe strength anisotropy prevents these types of aluminum-lithium wrought alloy products from being fully utilized in commercial applications.

The present invention produces an improved aluminum-lithium wrought alloy product having minimal strength anisotropy. This minimization of strength anisotropy results in a reduction in the difference between minimum and maximum tensile yield stresses for various directions and through thicknesses in the wrought product. Thus, aluminum-lithium wrought alloy products processed according to the present invention provide higher tensile yield stresses throughout. the thickness of the wrought product as well as in different directions. This increase in minimum tensile yield stress makes the aluminum-lithium alloy wrought product more attractive for commercial applications since the minimum design strength has effectively been increased by the inventive process.

In its broadest embodiment, the present invention is an improvement over conventional T8 temper practice. In conventional practice, an aluminum alloy wrought product is solution heat treated, quenched, stretched and aged to achieve a desired strength level. The stretching is usually in amounts between about 3% and 6%, with the previously mentioned U.S. Pat. No. 4,961,792 describing a range of cold work of 1 to 14% for a zinc-containing aluminum-lithium alloy, with all of the patent examples using stretching to provide the cold work.

As an improvement over the conventional practice, it has been discovered that a combination of cold rolling and stretching results in minimal strength anisotropy for aluminum-lithium alloys. The cold rolling and stretching steps according to the invention follow a solution heat treating and quenching step and precede an aging step for desired strength. The amount of cold rolling and stretching ranges from about 1–20% cold rolling and 0.5–10% stretch. More preferably, an amount of cold rolling and stretching ranges between 3–14% cold rolling and 1–6% stretch. In a most preferred embodiment, cold rolling ranges between 6–12%, with stretching ranging between 1.5 and 3% stretch.

In another mode of the present invention, the aluminum-lithium alloy wrought product can be subjected to multiple steps of cold rolling to further improve strength anisotropy. For a given amount of cold work, the multiple steps of cold rolling can be divided to achieve equal amounts of cold work. Alternatively, unequal amounts of cold rolling in multiple passes can also be utilized to achieve the target amount of cold work. For example, an 8% target of cold work can be achieved in two passes of 4% each. Likewise, a 12% cold work can be achieved with two passes of 6% each. On the other hand, the 12% cold work target can be divided between 2 passes, one 4% and one 8%.

In a further mode of the invention, the multiple cold rolling passes may be performed in different directions. This combination of cold rolling in different directions provides even further improved strength anisotropy than multiple cold rolling in the same direction. For example, an aluminum-lithium alloy wrought product can be cold rolled in the longitudinal direction followed by a second pass of cold rolling in the opposite direction. Alternatively, the wrought product may be cold rolled in a 45° direction in one pass with a second pass conducted in a −45° direction. Additional passes in yet another direction may also be included, for example, following the 45° and −45° directions with a third pass in a longitudinal direction. The 45 degree and −45 degree directions are measured with respect to the longitudinal direction for which hot rolling was done on the wrought product. Other directions of rolling than those disclosed may also be used.

It is believed that the inventive process is adaptable for any aluminum-lithium alloy products capable of achieving desired strength properties when subjected to T8 temper practice. For example, ternary alloys such as aluminum-lithium-copper or aluminum-lithium-magnesium may be subjected to the inventive processing. Other more complex alloys such as an aluminum-lithium-copper-magnesium alloy, may also be utilized with the present invention. All of these types of alloys may also include additional alloying elements such as zirconium, silver and/or zinc, as well as impurity elements such as iron, silicon and other inevitable impurities found in aluminum-lithium alloys.

More preferred alloys are the aluminum-lithium alloys including copper, magnesium, silver and zirconium as main alloying components. An alloy exemplary of this class of alloys includes the AAX2095 alloy registered with the Aluminum Association. This alloy typically includes about 3.9–4.6% copper, 0.25–0.6% magnesium, 0.04–0.18% zirconium, 0.25–0.6 silver, 1.0–1.6 lithium, with the remainder iron, silicon and inevitable impurities and aluminum.

Other preferred aluminum-lithium alloys include those disclosed in the previously mentioned U.S. Pat. No. 5,032,359 to Pickens et al. Of course, these alloys represent examples of various types of aluminum-lithium alloys adaptable for the inventive process.

The aging times and temperatures for the inventive process may vary dependent upon the desired strength levels in the final wrought product. Temperatures may range from about 250° F. up to 360° F. The time period for aging can range from 1 to up to several hundred hours depending on the particular strength properties desired. Aging also can be accomplished in multiple steps using different combinations of aging times and temperatures.

The preparation of aluminum-lithium alloy wrought products for processing according to the improved T8 temper practice is well known in the art. That is, the alloy may be provided as an ingot or billet which may be preliminarily worked or shaped to provide suitable stock for subsequent working operations. Prior to the principle working operation, the alloy stock is preferably subjected to stress relieving, sawing and homogenization. The homogenization may be conducted at temperatures in the range of 900°–1060° F. for a sufficient period of time to dissolve the soluble elements and homogenize the internal structure of the metal. A preferred homogenization residence time includes 1–48 hours, while longer times may be used without adverse effect on the product. Homogenization is also believed to precipitate dispersoids to help control and refine the final grain structure. The homogenization can be done at either one temperature or at multiple steps utilizing several temperatures.

After homogenization, the metal can be rolled, extruded, or otherwise worked to produce stock such as sheet, plate or other stock suitable for shaping into an end product. After homogenization, the alloy is typically hot worked, for example by rolling, to form a product. The product is then solution heat treated from less than an hour to several hours at a temperature of from about 930° F. to about 1030° F. To provide increased strength and fracture toughness in the final product, it is usually also necessary to rapidly quench the product after solution heat treating to prevent or minimize uncontrolled precipitation of strengthening phases in the alloy. Typically, this quenching step involves cold water quenching to a temperature of about 200° F. or lower. Other quenching medium may be used depending on the final strength requirement for the wrought product.

The inventive method also produces an aluminum-lithium wrought alloy product comprising shapes adaptable for further cold rolling or structural components in aircraft or aerospace use or the like. For example, sheets or plates may be fabricated using the inventive process. As will be described hereinafter, the final product sheets or plate exhibit a minimum of strength anisotropy. The aluminum-lithium alloy wrought product derived from the inventive method exhibits up to 50% reduction in differences between maximum and minimum yield stresses. For example, an aluminum-lithium alloy subjected to conventional practice exhibits an 18.9 ksi difference between high and low tensile yield stresses. In contrast, an aluminum-lithium alloy wrought product subjected to the inventive processing exhibits a difference of only 10.2 ksi. Aluminum-lithium alloy wrought products, when processed according to the present invention, exhibit minimum tensile yield stresses of at least 85% of the maximum tensile yield stresses. In certain instances, the minimum yield stresses can range as high as 90% or more of the maximum tensile yield stress. Thus, these aluminum-lithium alloy wrought products offer design engineers a high threshold limit for tensile yield stresses as a minimum design requirement for commercial application.

The following examples are presented to illustrate the invention but are not to be considered as limiting. In these examples and throughout the specification, parts are by weight percent unless otherwise indicated.

EXAMPLE I

Alloy Selection and Casting

An Aluminum Association alloy X2095 was selected as an aluminum-lithium type alloy to demonstrate the unexpected results associated with the inventive process. The aluminum-lithium alloy was DC cast into a 12 inch thick by 45 inch wide rectangular ingot having the following composition:

| Cu | Li | Mg | Ag | Zr | Fe | Si | Al |
|---|---|---|---|---|---|---|---|
| 4.01 | .96 | .36 | .38 | .14 | .06 | .04 | balance |

Processing

The cast ingot was then processed conventionally, including stress relief and homogenization.

The homogenized ingot was then hot rolled using a combination of cross rolling and straight rolling.

The hot rolled 1.6 inch gauge plates were then solution heat treated and cold water quenched to room temperature to a W-temper condition.

The following experiments were conducted to compare conventional T8 temper practice to the T8 temper practice according to the present invention.

The conventional T8 temper practice included stretching the W-tempered plate by 6% followed by aging at 290° F. for about 20 hours. The aging was done to put the plate in the range of 85–90 ksi tensile yield stress in the longitudinal direction.

In this experiment, the solution heat treated and quenched plate was subjected to three different T8 temper practices representative of the inventive method. The three temper practices are identified as practices A, B and C and outlined as follows:

Practice A

1) Cold roll 12% (0.18") in the straight longitudinal direction;
2) Stretch 2%; and
3) Age at 290° F. for 24 hours.

Practice B

1) Cold roll W-temper plate by 6% (0.09" reduction) in the straight longitudinal direction;
2) Cold roll W-temper plate by 6% (0.09" reduction) in the straight longitudinal direction (same as step 1);
3) Stretch 2%; and
4) Age at 290° F. for 24 hours.

Practice C

1) Cold roll W-temper plate by 6% (0.09" reduction) in straight longitudinal direction;
2) Cold roll W-temper plate by 6% (0.09" reduction) in straight longitudinal direction in the reversed or opposite direction of step 1;
3) Stretch 2%; and
4) Age at 290° F. for 24 hours.

Mechanical Property Testing

To evaluate the directional strength anisotropy, tensile specimens were machined in the three directions including longitudinal (L), long transverse (LT) and 45 degree direction (45) relative to the rolling direction. Tensile tests in the short transverse direction (ST) were conducted on all samples to meet 2% minimum elongation and ensure against poor short transverse (ST) ductility.

Mechanical Property Test Results

Tensile test results for the conventional T8 temper practice and the T8 temper practice according to the invention are listed in Tables I–IV. The tensile test specimens were machined at three locations of T/2, T/4 and T/8 representing the through-thickness strength variations of the plates tested. It should be noted that the tensile test results in L, LT and 45 deg. direction at T/2, T/4 and T/8 locations are average values from duplicates tested with 0.113" diameter subsize specimens for Table I. The average values set forth in Tables II–IV were derived from duplicates tested with 0.100" thick subsize sheet specimens. For Tables I--IV, the ST-dir. tensile tests were derived from 0,113" diameter subsize specimens from duplicates. Each of Tables I–IV illustrates test results on the X2095 plate obtained according to the above-described processing conditions.

Table I illustrates the results of the conventional 6% stretch and aging practice, i.e. aged for 20 hours at 290° F. This stretch and aging practice will be hereinafter referred to as the conventional practice. Tensile yield stress (TYS) results after conventional T8 temper practice are represented for each location (T/2, T/4 and T/8) and each direction (L, LT and 45 deg.).

The conventional practice results in an acceptable longitudinal tensile yield stress at T/2 of 85.9 ksi. However, a 45 degree direction TYS at the T/2 location is only 73 ksi. Furthermore, the TYS at the T/8 location in the longitudinal direction is only 71.5 ksi and at the 45 direction TYS is only 67.0 ksi, as illustrated in Table I and FIG. 1.

The longitudinal TYS of 85.9 ksi at the T/2 location compared with the longitudinal TYS of 71.5 ksi at the T/8 location yields a difference of 14.4 ksi. The longitudinal T/2 TYS of 85.9 ksi compared with the 45 degree direction TYS of 67.0 ksi at the T/8 location represent a difference of 18.9 ksi. These extreme variations in TYS at different locations and directions are illustrative of the severe strength anisotropy and non-uniformity in through-thickness in using the conventional T8 temper practice, namely stretch and aging practice. Such a severity of the strength anisotropy prevents aluminum-lithium alloy T8 temper product from full utilization of the high strength capability of the alloy system.

Table II data illustrate the effect of a first mode of the inventive practice, Practice A: cold roll 12%, then 2% stretch and age for 24 hours at 290° F. The difference between the highest tensile yield stress (i.e. TYS at T/4 in longitudinal direction) and the lowest tensile yield stress (i.e. TYS at T/8 in 45 degree direction) is 15.5 ksi.

FIG. 1 compares the results from Table I and Table II. Practice A improved the uniformity of the tensile yield stresses in the L and LT directions and reduced the through-thickness variability significantly. The minimum strength increases are an improvement over the conventional T8 temper practice.

Table III data illustrates the effect of another mode of the inventive practice, Practice B: 6% cold work by cold rolling and an additional 6% cold work by cold rolling in the same direction, then 2% stretch and aging: age for 24 hours at 290° F. The difference between the highest tensile yield stress (i.e. TYS at T/2 in longitudinal direction) and the lowest tensile yield stress (i.e. TYS at T/2 in 45 degree direction) is 13.8 ksi.

Figure 2:
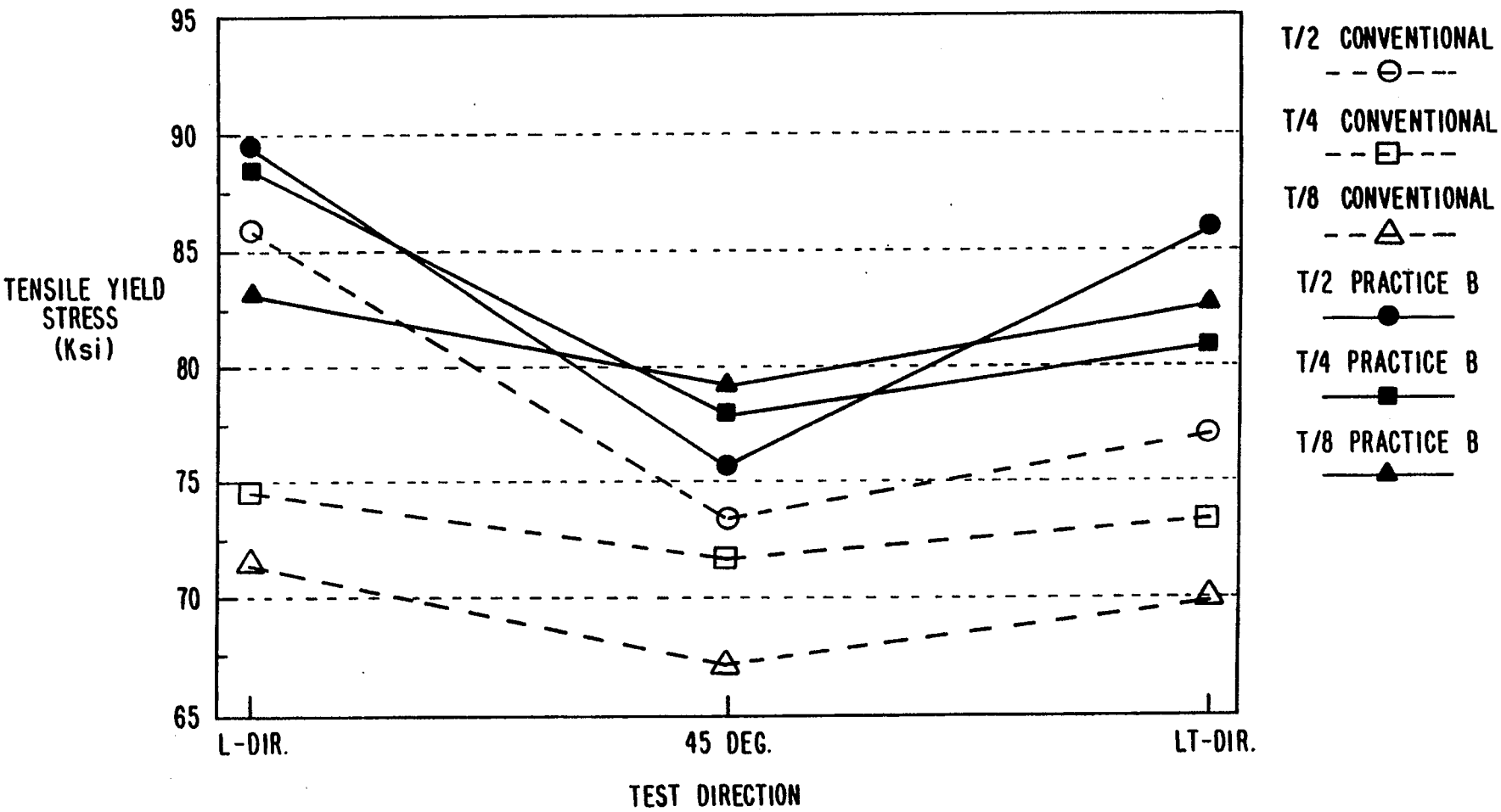
FIG. 2 is a graph similar to FIG. 1 comparing the conventional temper practice to a second embodiment of the inventive process.

FIG. 2 compares the results from Table I and Table III. Practice B unexpectedly improved the uniformity of the tensile yield stresses in all three directions at all three locations, T/2, T/4 and T/8, in the plate.

Table IV data illustrates the effect of yet another mode of the inventive practice, Practice C: 6% cold work by cold rolling and an additional 6% cold work by cold rolling in the reversed direction, then 2% stretch and aging for 24 hours at 290° F. The difference between the highest tensile yield stress (i.e. TYS at T/2 in longitudinal direction) and the lowest tensile yield stress (i.e. TYS at T/2 in 45 degree direction) is 10.2 ksi.

Figure 3:
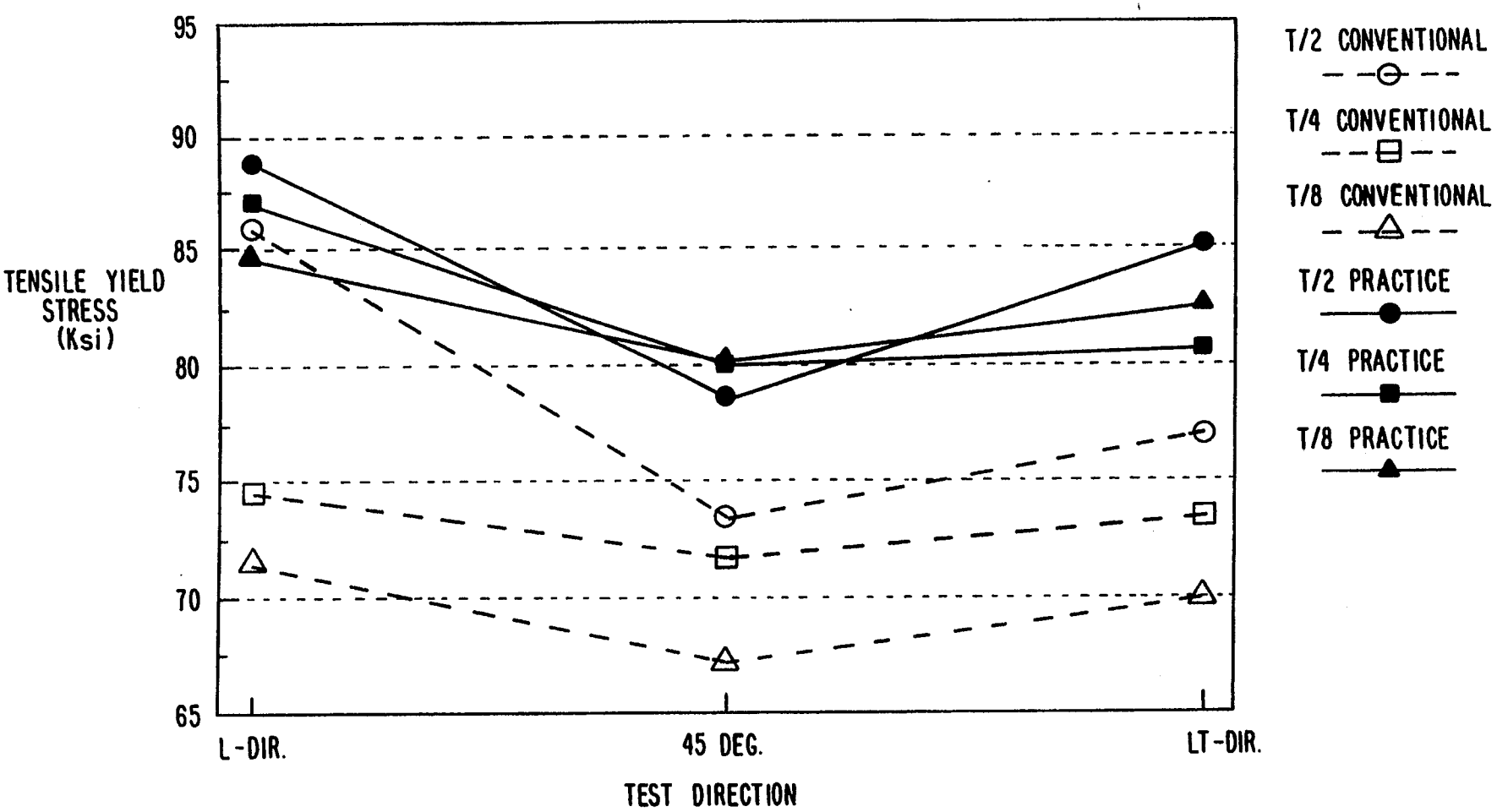
FIG. 3 is another graph similar to FIG. 1 comparing the conventional temper practice to a third embodiment of the inventive process.

FIG. 3 compares the results from Table I and Table IV. Practice C further unexpectedly improved the uniformity of the tensile yield stresses over the Practice B in all three directions at all three locations, T/2, T/4 and T/8, in the plate.

Figure 4:
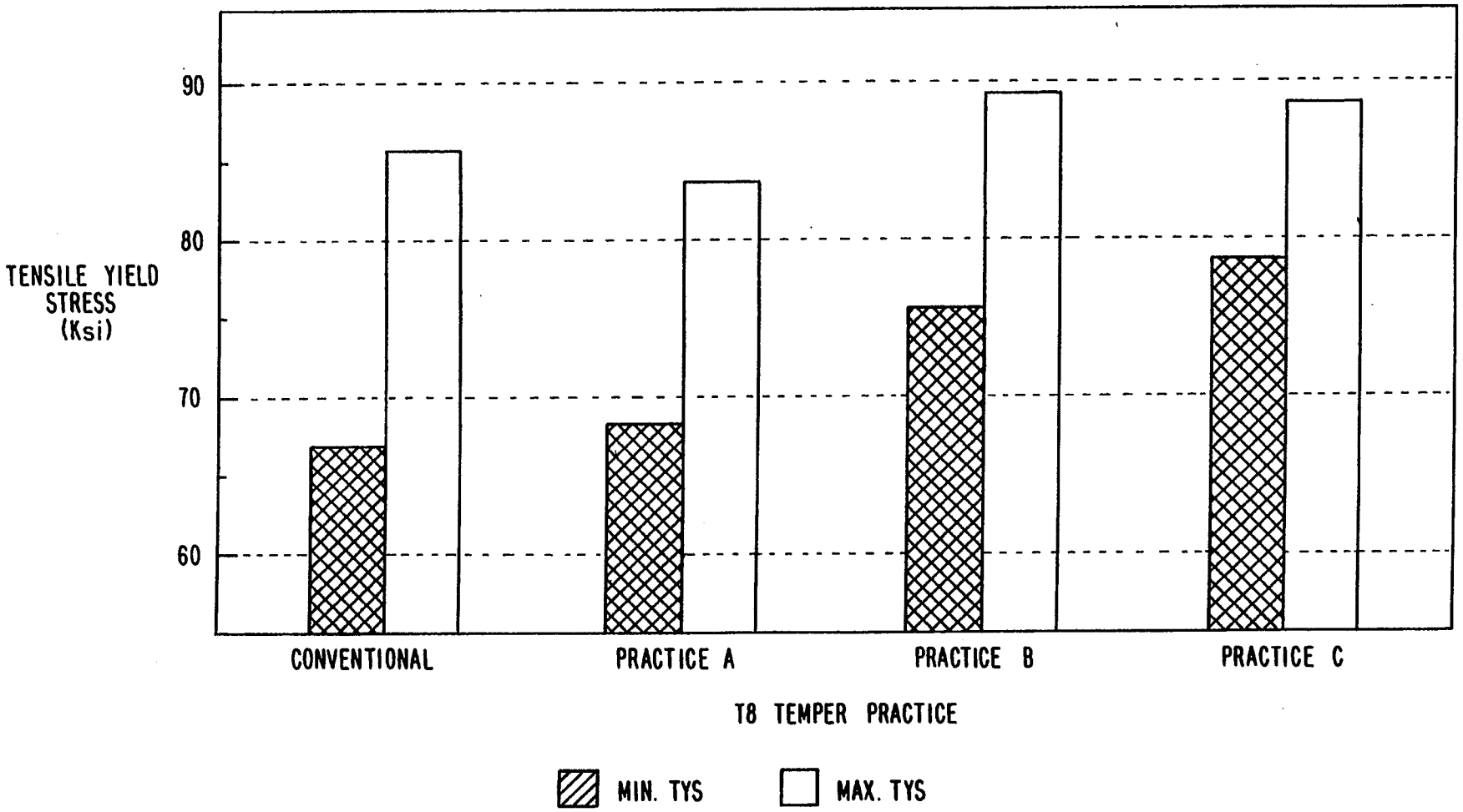
FIG. 4 is a bar graph relating minimum and maximum tensile yield stress between the conventional temper practice and the inventive process.

Table V and FIG. 4 summarize the effectiveness of the inventive T8 temper practices (Practice A, B and C) in reducing strength anisotropy by increasing the lowest TYS values. While all three new T8 temper practices were effective in reducing strength anisotropy of the plate, Practice C was the most effective in increasing the lowest TYS value and minimizing the strength anisotropy.

EXAMPLE II

In this example, a different aluminum-lithium alloy was selected for processing according to the inventive temper practice. The aluminum-lithium alloy was DC cast into a 12" thick by 45" rectangular ingot having the following composition:

| Cu | Li | Mg | Ag | Zr | Fe | Si | Al |
|---|---|---|---|---|---|---|---|
| 2.53 | 1.63 | .38 | .35 | .14 | .03 | .02 | balance |

Processing

The cast ingot was then processed conventionally, including stress relief and homogenization.

The homogenized ingot was hot rolled using a combination of cross rolling and straight rolling. The 1.6" gauge F-temper plates were solution heat treated and cold water quenched to W-temper condition.

For the aluminum-lithium alloy of Example II, a comparison was made between a conventional T8 temper practice and 3 different modes of the inventive T8 temper practice. The conventional T8 temper practice was as follows:

The W-temper plate was stretched by 6% followed by aging at 320° F. for about 24 hours to approximately 75 ksi to 80 ksi tensile yield stress in the longitudinal direction at T/2 location.

Three temper practices were outlined according to the present invention. The inventive temper practices are outlined as Practice D, E and F as follows:

Practice D

1) Cold roll W-temper plate by 6% (0.09" reduction) in the straight longitudinal direction;
2) Stretch 2%; and
3)

Age at 320° F. for 24 hours to approximately 75 to 80 ksi tensile yield stress in the longitudinal direction.

Practice E

1) Cold roll W-temper plate by 4% (0.06" reduction) in 45 degree direction relative to the rolling direction;
2) Cold roll by 4% (0.06" reduction) in −45 degree direction relative to the rolling direction;
3) Stretch 4%;
4) Age at 320° F. for 24 hours to approximately 75 to 80 ksi tensile yield stress in the longitudinal direction.

Practice F

1) Cold roll W-temper plate by 4% (0.06" reduction) in 45 degree direction relative to the hot rolling direction;
2) Cold roll by 4% (0.06" reduction) in −45 degree direction relative to the hot rolling direction;
3) Cold roll by 2% (0.03" reduction) in the straight longitudinal direction;
4) Stretch 2%;
5) Age at 320° F. for 24 hours to approximately 75 to 80 ksi tensile yield stress in longitudinal direction.

Mechanical Property Testing

The evaluation of the directional strength anisotropy for Example II with respect to tensile specimens was done in the same manner as for Example I.

Mechanical Property Test Results and Discussion

The tensile test results obtained from comparing the conventional T8 temper practice to Practices D, E and F are illustrated in Tables VI–IX. Tensile tests in the L, 45 & LT directions were conducted with 0.120" thick×0.25" wide subsize sheet specimens. All the properties are averaged values from duplicates.

Table VI data illustrate the effect of the conventional 6% stretch and aging practice: age for 24 hours at 320° F. (hereinafter referred to as conventional practice). The maximum TYS values for the inventive processes were lower than the values for the conventional processes. The alloys aged with the inventive processes, however, could have been aged longer to obtain higher maximum and minimum TYS values, without a significant adverse impact on fracture toughness properties.

The conventional practice results in an acceptable longitudinal tensile yield stress at T/2 of 78 ksi. However, a 45 degree direction TYS at the T/2 location is only 66 ksi. Furthermore, the TYS at the T/8 location in the longitudinal direction is only 69 ksi and at the 45 direction TYS, only 64.9 ksi, as illustrated in Table VI and FIG. 5.

The longitudinal TYS of 78 ksi at the T/2 location compared with the longitudinal TYS of 69 ksi at the T/8 location yields a difference of 9 ksi, and the longitudinal T/2 TYS of 78 ksi compared with the 45 degree direction TYS of 64.9 ksi at the T/8 location represent a significant difference of 13.1 ksi. These extreme variations in TYS at different locations and directions are illustrative of the severe strength anisotropy and non-uniformity in through-thickness resulting from using the conventional T8 temper practice: namely stretch and aging practice. Such a severity of the strength anisotropy prevents aluminum-lithium alloy T8 temper product from full utilization of the high strength capability of the alloy system.

Table VII data illustrates the effect of one mode of the invention practice, (Practice D): cold roll 6%, then 2% stretch and age for 24 hours at 320° F. The difference between the highest tensile yield stress (i.e. TYS of 75.1 ksi at T/4 in longitudinal direction) and the lowest tensile yield stress (i.e. TYS of 65.9 ksi at T/2 in 45 degree direction) is 9.8 ksi.

Figure 5:
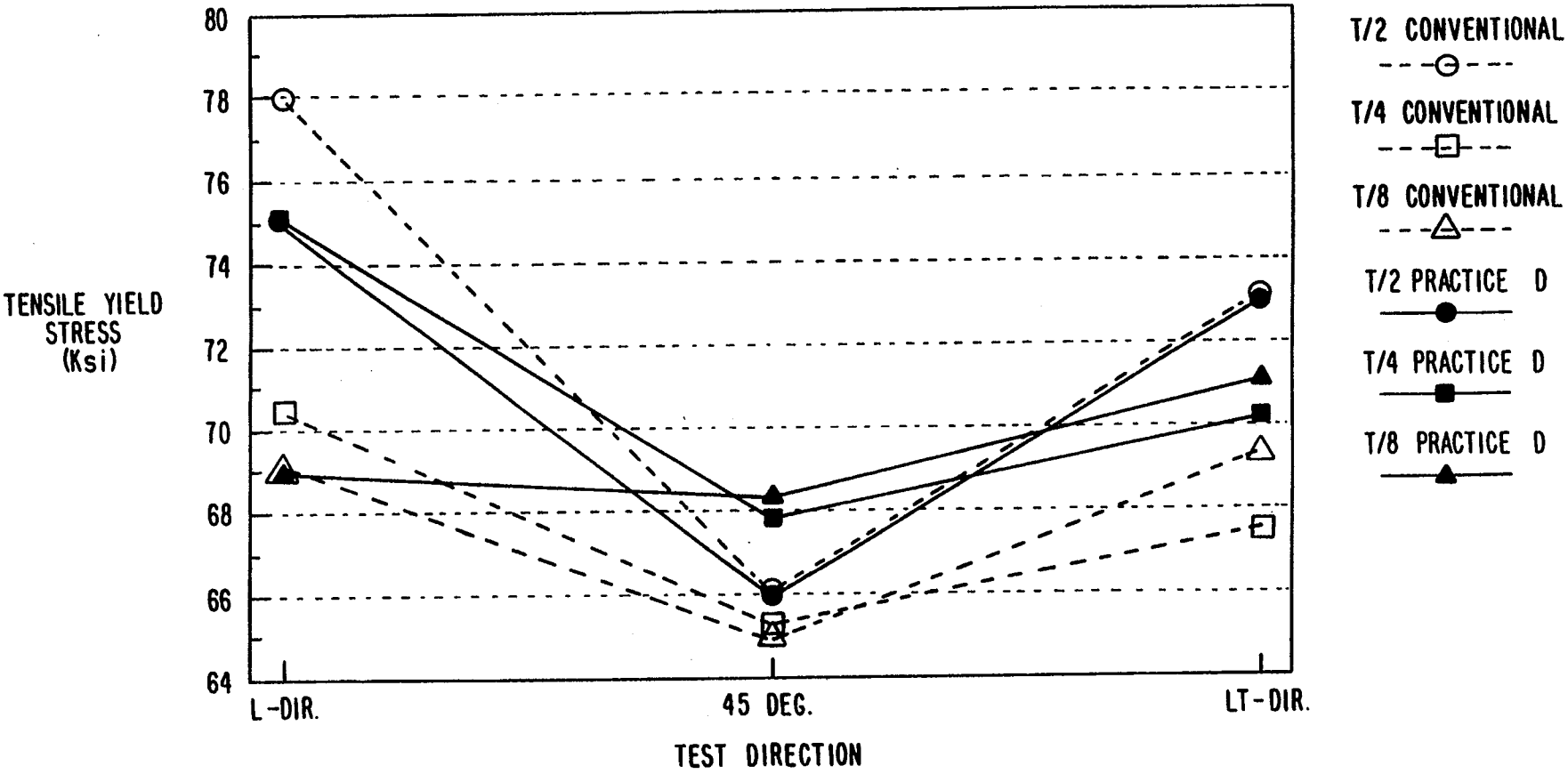
FIG. 5 is another graph similar to FIG. 1 utilizing a different aluminum-lithium alloy and comparing conventional temper practice to a fourth embodiment of the inventive process.

FIG. 5 compares the results from Table VI and Table VII. Practice D improved the uniformity of the tensile yield stresses by increasing the lowest strength by 1 ksi and decreasing the highest strength by 2.9 ksi. Practice D shows an improvement over the conventional T8 temper practice in that a higher minimum value is achieved. The product, if aged longer, could have a maximum strength value comparable to the maximum strength value achieved with the conventional practices. Longer aging would also increase the minimum TYS value achieved with the inventive practice.

Table VIII data illustrates the effect of another inventive practice, Practice E: 4% cold work by cold rolling in the 45 degree direction and an additional 4% cold work by cold rolling in the −45 degree direction, then 4% stretch and aging for 24 hours at 320° F. The difference between the highest tensile yield stress (i.e. TYS of 76.3 ksi at T/2 in long transverse direction) and the lowest tensile yield stress (i.e. TYS of 66.2 ksi at T/4 in 45 degree direction) is 10.1 ksi.

Figure 6:
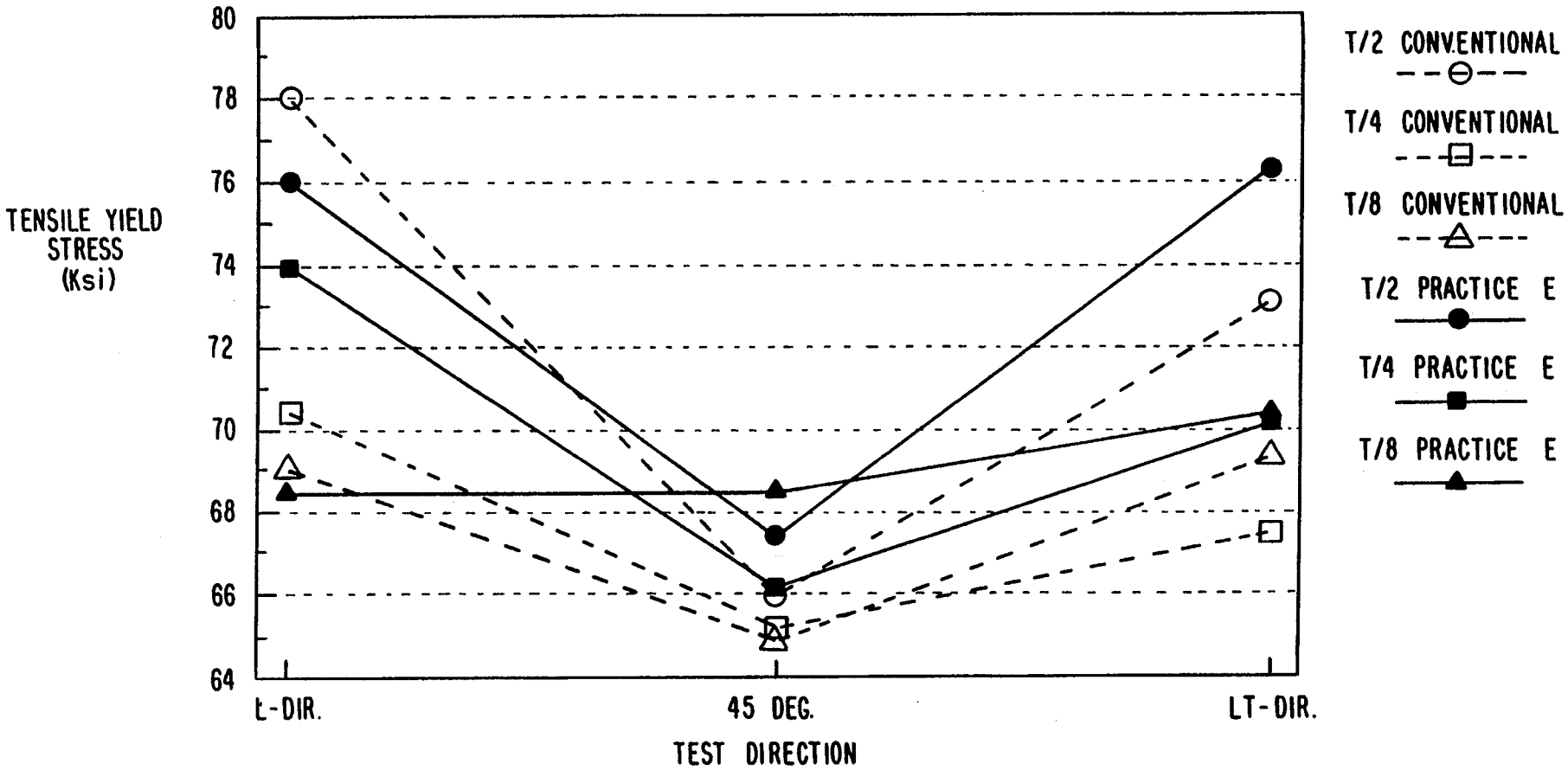
FIG. 6 is a graph similar to FIG. 5 comparing conventional temper practice to a fifth embodiment of the inventive process.

FIG. 6 compares the results from Table VI and Table VIII. Practice E improved the uniformity of the tensile yield stresses by decreasing the highest strength by 2 ksi and increasing the lowest strength by 1.3 ksi. Practice E also shows improvement over the conventional practice.

Table IX data illustrates the effect of another mode of the inventive practice, Practice F: 4% cold work by cold rolling in the 45 degree direction, an additional 4% cold work by cold rolling in the −45 degree direction, 2% cold work by cold rolling in the straight longitudinal direction and then 2% stretch and aging: age for 24 hours at 320° F. The difference between the highest tensile yield stress (i.e. TYS at T/2 in longitudinal direction) and the lowest tensile yield stress (i.e. TYS at T/2 in 45 degree direction) is only 7.7 ksi.

Figure 7:
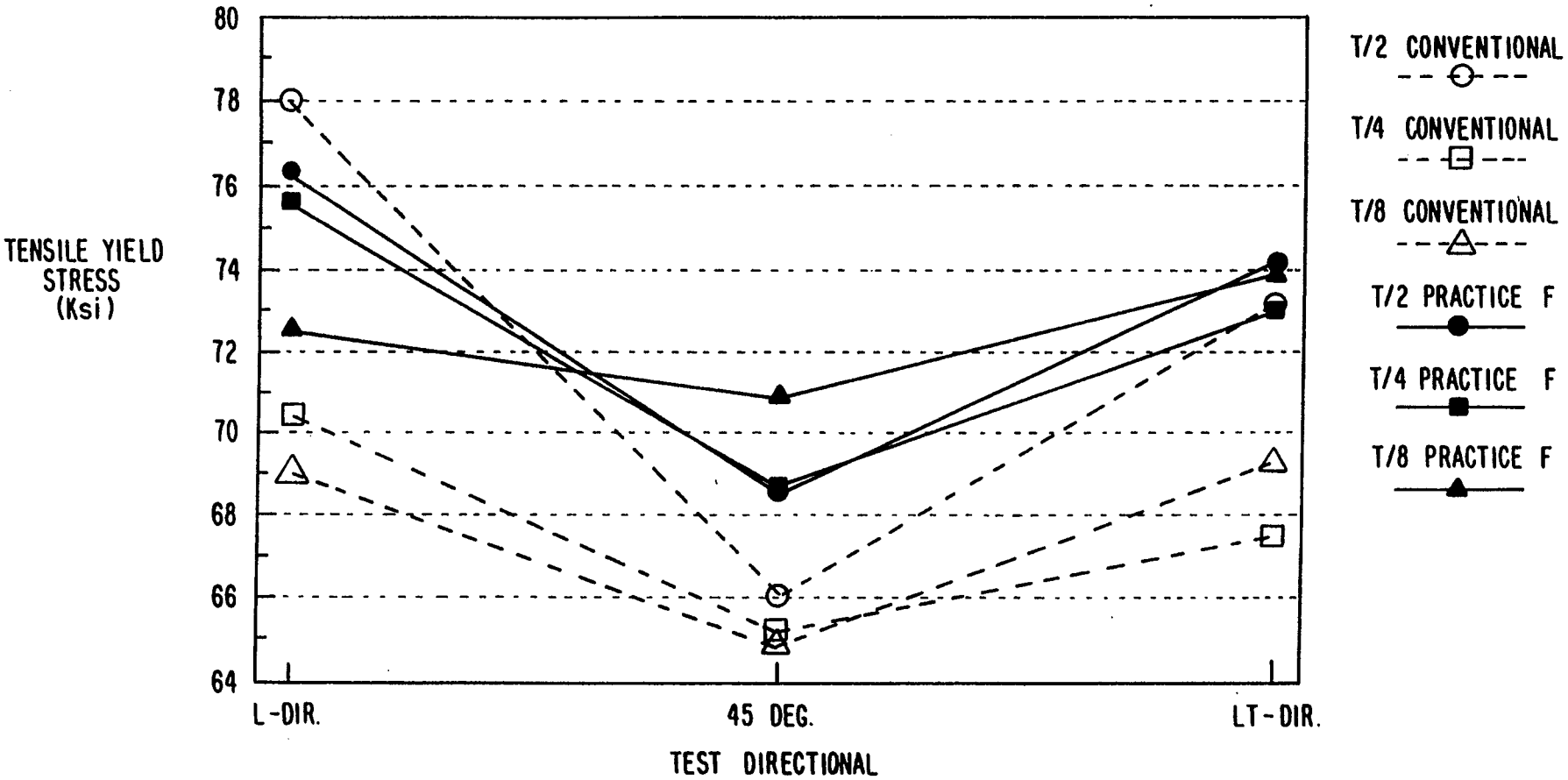
FIG. 7 is a graph similar to FIG. 5 comparing conventional temper practice to a sixth embodiment of the inventive process.

FIG. 7 compares the results from Table VI and Table IX. Practice F significantly and unexpectedly improves the uniformity of the tensile yield stresses over the conventional T8 type temper practice.

Figure 8:
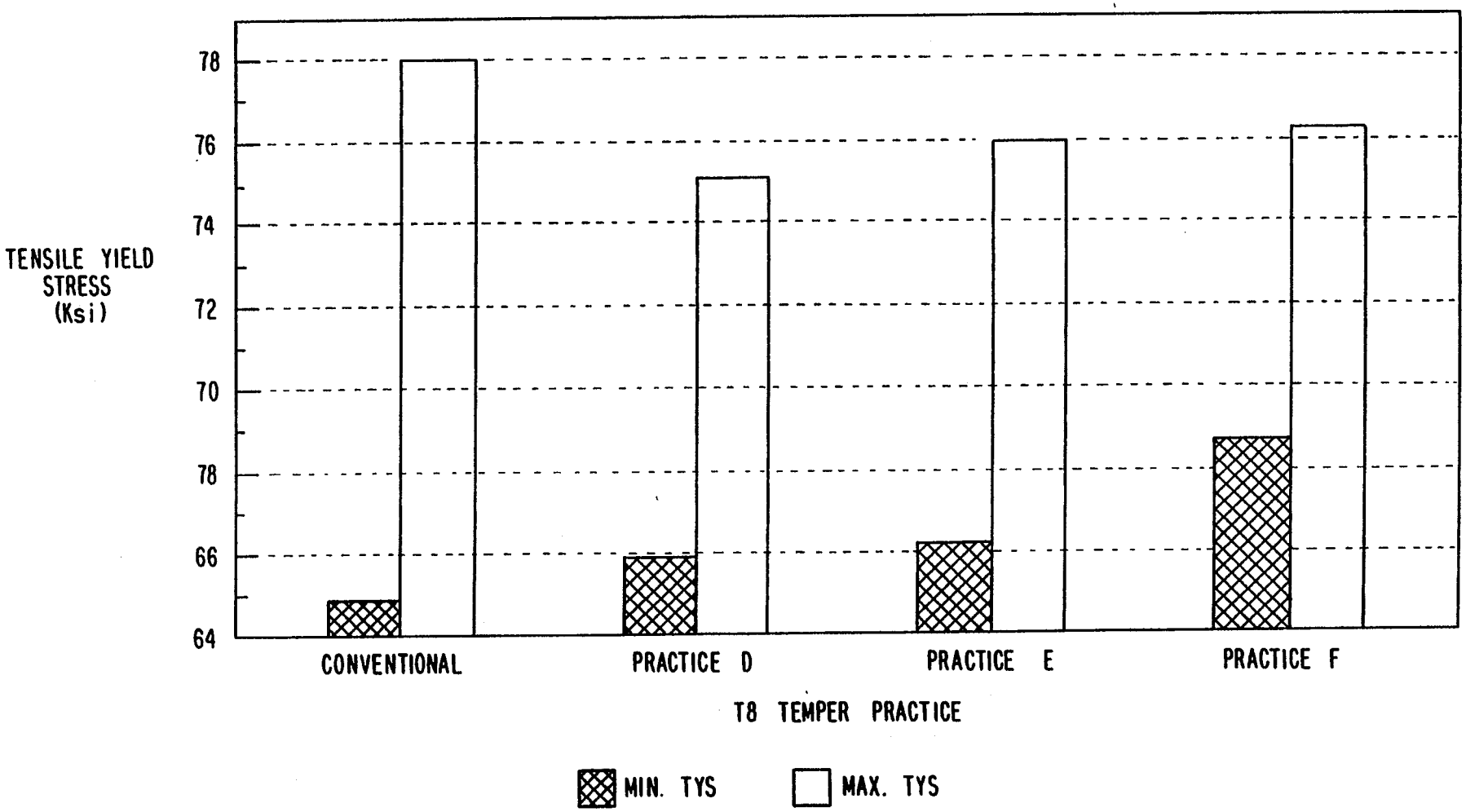
FIG. 8 is graph similar to FIG. 4 using another aluminum-lithium alloy.

Table X and FIG. 8 summarize the effectiveness of the new T8 temper practices (Practices D, E and F) in reducing strength anisotropy by increasing the lowest TYS values. While all three new T8 temper practices were effective in reducing strength anisotropy of the plate, Practice F was the most effective in increasing the lowest TYS value and minimizing the strength anisotropy.

The above described examples demonstrate the unexpected improvements in strength anisotropy in aluminum-lithium alloys when subjected to the improved T8 temper practice according to the invention. Minimizing the differences between minimum and maximum strength values by the combination of cold rolling and stretching between the solution heating and aging steps of the temper practice improves the strength anisotropy for these age hardenable aluminum-lithium alloys.

As such, an invention has been disclosed in terms of preferred embodiments thereof that fulfill each and every one of the objects of the present invention as set forth hereinabove and provide a new and improved T8 temper practice for aluminum-lithium alloy wrought products.

Various changes, modifications and alterations from the teachings of the present invention may be contemplated by those skilled in the art without departing from the intended spirit and scope thereof. Accordingly, it is intended that the present invention only be limited by the terms of the appended claims.

TABLE I

Conventional Practice: 6% Stretch + age at 290° F./20 hours

| Loc. | Dir. | UTS (ksi) | TYS (ksi) | El. (%) |
|---|---|---|---|---|
| T/2 | L | 91.0 | 85.9 | 7.8 |
| | 45 | 80.4 | 73.4 | 5.8 |
| | LT | 84.1 | 77.1 | 8.4 |
| T/4 | L | 77.8 | 74.5 | 15.0 |
| | 45 | 78.4 | 71.7 | 15.0 |
| | LT | 80.3 | 73.5 | 12.1 |
| | ST | 85.7 | 76.0 | 8.2 |
| T/8 | L | 76.4 | 71.5 | 13.2 |
| | 45 | 76.4 | 67.0 | 13.5 |
| | LT | 79.6 | 70.0 | 11.1 |

TABLE II

Practice A: 12% Cold Roll + 2% Stretch + age at 290° F./24 hours

| Loc. | Dir. | UTS (ksi) | TYS (ksi) | El. (%) |
|---|---|---|---|---|
| T/2 | L | 87.2 | 81.2 | 10.0 |
| | 45 | 79.6 | 73.9 | 10.0 |
| | LT | 87.1 | 81.1 | 10.5 |
| T/4 | L | 88.5 | 83.8 | 10.0 |
| | 45 | 81.7 | 75.5 | 10.5 |
| | LT | 85.9 | 79.9 | 9.5 |
| | ST | 81.5 | 73.3 | 5.6 |
| T/8 | L | 85.2 | 82.6 | 11.0 |
| | 45 | 75 | 68.3 | 12.0 |
| | LT | 88.8 | 82.4 | 11.0 |

TABLE III

Practice B: 6% Cold Roll + 6% Cold Roll in the same direction + 2% stretch + age at 290° F./24 hours

| Loc. | Dir. | UTS (ksi) | TYS (ksi) | El. (%) |
|---|---|---|---|---|
| T/2 | L | 91.5 | 89.5 | 7.0 |
| | 45 | 81.6 | 75.7 | 9.5 |
| | LT | 90.0 | 86.0 | 7.0 |
| T/4 | L | 90.4 | 88.6 | 7.0 |
| | 45 | 84.4 | 78.0 | 9.5 |
| | LT | 87.3 | 81.0 | 6.0 |
| | ST | 85.9 | 74.4 | 5.6 |
| T/8 | L | 85.5 | 83.2 | 9.0 |
| | 45 | 86.2 | 79.2 | 9.5 |
| | LT | 88.6 | 82.8 | 8.0 |

TABLE IV

Practice C: 6% Cold Roll + 6% Cold Roll in the reversed direction + 2% stretch + age at 290° F./24 hours

| Loc. | Dir. | UTS (ksi) | TYS (ksi) | El. (%) |
|---|---|---|---|---|
| T/2 | L | 91.2 | 88.8 | 9.0 |
| | 45 | 85.2 | 78.6 | 9.0 |
| | LT | 91.1 | 85.2 | 8.0 |
| T/4 | L | 89.6 | 87.0 | 9.5 |
| | 45 | 85.7 | 80.1 | 9.0 |
| | LT | 87.5 | 80.7 | 8.0 |
| | ST | 86.8 | 74.8 | 4.4 |
| T/8 | L | 86.5 | 84.7 | 8.5 |
| | 45 | 86.0 | 80.2 | 10.0 |
| | LT | 89.1 | 82.6 | 8.5 |

TABLE V

Differences between the Highest and Lowest Tensile Yield Stresses (TYS) from the plates processed according to the Inventive T8 temper practices and conventional practice

| | Conventional | Practice A | Practice B | Practice C |
|---|---|---|---|---|
| High | 85.9 ksi | 83.8 ksi | 89.5 ksi | 88.8 ksi |
| Low | 67.0 ksi | 68.3 ksi | 75.7 ksi | 78.6 ksi |
| Diff | 18.9 ksi | 15.5 ksi | 13.8 ksi | 10.2 ksi |
| (Diff/High) | 22% | 18% | 15% | 11% |

TABLE VI

Conventional Practice: 6% Stretch + age at 320° F./24 hours

| Loc. | Dir. | UTS (ksi) | TYS (ksi) | El. (%) |
|---|---|---|---|---|
| T/2 | L | 82.6 | 78.0 | 9.5 |
| | 45 | 73.4 | 66.0 | 10.0 |
| | LT | 79.9 | 73.1 | 7.0 |
| T/4 | L | 74.9 | 70.4 | 9.5 |
| | 45 | 73.4 | 65.2 | 10.0 |
| | LT | 75.3 | 67.5 | 8.5 |
| T/8 | L | 73.6 | 69.0 | 10.0 |
| | 45 | 73.7 | 64.9 | 10.0 |
| | LT | 76.6 | 69.3 | 9.0 |

TABLE VII

Practice D: 6% Cold Roll + 2% Stretch + age at 320° F./24 hours

| Loc. | Dir. | UTS (ksi) | TYS (ksi) | El. (%) |
|---|---|---|---|---|
| T/2 | L | 80.9 | 75.0 | 9.5 |
| | 45 | 72.2 | 65.9 | 12.0 |
| | LT | 78.4 | 73.0 | 9.5 |
| T/4 | L | 80.9 | 75.1 | 9.5 |
| | 45 | 75.6 | 67.8 | 11.0 |
| | LT | 77.1 | 70.2 | 9.5 |
| T/8 | L | 72.6 | 68.9 | 11.0 |
| | 45 | 75.0 | 68.3 | 12.0 |
| | LT | 77.5 | 71.1 | 9.0 |

TABLE VIII

| Practice E: 4% Cold Roll in 45 deg. + 4% Cold Roll in −45 deg. + 4% Stretch + age at 320° F./24 hours | | | | |
|---|---|---|---|---|
| Loc. | Dir. | UTS (ksi) | TYS (ksi) | El. (%) |
| T/2 | L | 81.5 | 76.0 | 9.0 |
| | 45 | 73.9 | 67.4 | 10.0 |
| | LT | 81.5 | 76.3 | 8.0 |
| T/4 | L | 79.5 | 73.9 | 9.0 |
| | 45 | 73.8 | 66.2 | 11.0 |
| | LT | 76.6 | 70.2 | 9.5 |
| T/8 | L | 72.2 | 68.5 | 10.5 |
| | 45 | 75.4 | 68.5 | 10.0 |
| | LT | 76.7 | 70.4 | 9.0 |

TABLE IX

| Practice F: 4% Cold Roll in 45 deg. + 4% Cold Roll in −45 deg. + 2% Cold Roll in straight direction + 2% Stretch + age at 320° F. for 24 hours | | | | |
|---|---|---|---|---|
| Loc. | Dir. | UTS (ksi) | TYS (ksi) | El. (%) |
| T/2 | L | 79.7 | 76.3 | 8.5 |
| | 45 | 74.2 | 68.6 | 10.0 |
| | LT | 81.0 | 74.2 | 8.0 |
| T/4 | L | 79.0 | 75.6 | 10.0 |
| | 45 | 75.6 | 68.7 | 11.0 |
| | LT | 78.9 | 73.0 | 7.0 |
| T/S | L | 74.6 | 72.5 | 10.0 |
| | 45 | 75.8 | 70.9 | 11.0 |
| | LT | 78.8 | 73.9 | 9.5 |

TABLE X

| Differences between the Highest and Lowest Tensile Yield Stresses (TYS) from the plates processed according to the Inventive T8 temper practices and conventional practice | | | | |
|---|---|---|---|---|
| | Conventional | Practice D | Practice E | Practice F |
| High | 78.0 ksi | 75.1 ksi | 76.0 ksi | 76.3 ksi |
| Low | 64.9 ksi | 65.9 ksi | 66.2 ksi | 68.7 ksi |
| Diff | 13.1 ksi | 9.2 ksi | 9.8 ksi | 7.6 ksi |
| (% Diff/ High) | 16% | 12% | 12% | 10% |

What is claimed is:

1. A rolled aluminum-lithium alloy product having reduced strength anisotropy made by the process comprising the steps of:

a) cold rolling a solution heat treated and quenched aluminum-lithium alloy product in at least one pass in an amount of at least 3% reduction;

b) stretching said cold rolled product an amount between 0.5 and 10%; and c) aging said cold rolled and stretched product to increase its strength whereby the combined cold rolling and stretching provide a rolled aluminum-lithium alloy product having reduced strength anisotropy.

2. A rolled aluminum-lithium alloy product according to claim 1, wherein the amount of cold rolled reduction is between 3 and 14%.

3. A rolled aluminum-lithium alloy product according to claim 1, wherein the amount of cold rolled reduction is between 6 and 12%.

4. A rolled aluminum-lithium alloy product according to claim 1, wherein the product is a plate product.

5. A rolled aluminum-lithium alloy product according to claim 2, wherein the amount of stretch is between 1 and 6%.

6. A rolled aluminum-lithium alloy product according to claim 3, wherein the amount of stretch is between 1.5 and 3%.

7. A rolled aluminum-lithium alloy product having reduced strength anisotropy made by the process comprising the steps of:

a) providing an aluminum-lithium wrought alloy product selected from the group consisting of aluminum-lithium-copper type alloys, aluminum-lithium-magnesium type alloys, aluminum-lithium-copper-magnesium type alloys, aluminum-lithium-copper-magnesium-silver type alloys, aluminum-magnesium-lithium-silver type alloys, aluminum-magnesium-lithium-silver-zinc type alloys, and aluminum-magnesium-lithium-zinc type alloys;

b) solution heat treating and quenching the wrought alloy product;

c) cold rolling the solution heat treated and quenched aluminum-lithium wrought alloy product in at least one pass in an amount of at least 3% reduction;

d) stretching said cold rolled product an amount between 0.5 and 10%; and e) aging said cold rolled and stretched product to increase its strength whereby the combined cold rolling and stretching provide a rolled aluminum-lithium alloy product having reduced strength anisotropy.

8. The rolled aluminum-lithium alloy wrought product of claim 7 wherein said aluminum-lithium alloy wrought product is an aluminum-lithium-copper-magnesium-silver type alloy.

9. The rolled aluminum-lithium alloy wrought product of claim 7 wherein said rolled aluminum-lithium alloy product has a minimum and maximum tensile yield stress and the minimum tensile yield stress is at least 85% of said maximum tensile yield stress.

10. A rolled aluminum-lithium alloy product according to claim 7, wherein the amount of cold rolled reduction is between 3 and 14%.

11. A rolled aluminum-lithium alloy product according to claim 7, wherein the amount of cold rolled reduction is between 6 and 12%.

12. A rolled aluminum-lithium alloy product according to claim 10, wherein the amount of stretch is between 1 and 6%.

13. A rolled aluminum-lithium alloy product according to claim 10, wherein the product is a plate product.

14. A rolled aluminum-lithium alloy product according to claim 11, wherein the amount of stretch is between 1.5 and 3%.

15. A rolled aluminum-lithium alloy product having reduced strength anisotropy made by the process comprising the steps of:

a) providing a solution heat treated and quenched aluminum-lithium alloy wrought product;

b) cold rolling said wrought product to a predetermined percent reduction in a plurality of passes, at least two of said passes being in different directions;

c) stretching said cold rolled product an amount between 0.5 and 10% reduction; and d) aging said cold rolled and stretched product to increase its strength whereby the combined cold rolling and stretching provide a rolled aluminum-lithium alloy product having reduced strength anisotropy.

16. A rolled aluminum-lithium alloy product according to claim 15, wherein the amount of cold rolled reduction is between 3 and 14%.

17. A rolled aluminum-lithium alloy product according to claim 15, wherein the amount of cold rolled reduction is between 6 and 12%.

18. The rolled aluminum-lithium alloy product of claim 15 wherein said rolled alloy product has a minimum and maximum tensile yield stress and said minimum tensile yield stress is at least about 85% of said maximum tensile yield stress.

19. A rolled aluminum-lithium alloy product according to claim 16, wherein the amount of stretch is between 1 and 6%.

20. A rolled aluminum-lithium alloy product according to claim 17, wherein the amount of stretch is between 1.5 and 3%.

* * * * *